US007403198B2

(12) United States Patent
Lin

(10) Patent No.: US 7,403,198 B2
(45) Date of Patent: Jul. 22, 2008

(54) DRIVING CIRCUIT OF LIQUID CRYSTAL DISPLAY

(75) Inventor: Che-Li Lin, Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 490 days.

(21) Appl. No.: 10/709,849

(22) Filed: Jun. 2, 2004

(65) Prior Publication Data

US 2005/0212735 A1 Sep. 29, 2005

(30) Foreign Application Priority Data

Mar. 29, 2004 (TW) ..... 93108464 A

(51) Int. Cl.
*G09G 5/00* (2006.01)

(52) U.S. Cl. ..... 345/211; 345/52; 345/87

(58) Field of Classification Search ..... 345/52, 345/211, 87, 212, 213, 214
See application file for complete search history.

(56) References Cited

U.S. PATENT DOCUMENTS

| | | | | |
|---|---|---|---|---|
| 2004/0085371 | A1* | 5/2004 | Lee et al. | 346/45 |
| 2004/0113881 | A1* | 6/2004 | Kim | 345/97 |
| 2004/0164943 | A1* | 8/2004 | Ogawa et al. | 345/92 |
| 2004/0227895 | A1* | 11/2004 | Yoo et al. | 349/152 |

FOREIGN PATENT DOCUMENTS

| | | |
|---|---|---|
| JP | 06004046 | 1/1994 |
| JP | 2000-310768 | 11/2000 |
| JP | 2001-134246 | 5/2001 |
| JP | 2001-166726 | 6/2001 |
| JP | 2004-021067 | 1/2004 |

* cited by examiner

*Primary Examiner*—Sumati Lefkowitz
*Assistant Examiner*—Seokyun Moon
(74) *Attorney, Agent, or Firm*—Jianq Chyun IP Office

(57) ABSTRACT

A driving circuit of a liquid crystal display is provided. The driving circuit comprises: a plurality of gate drivers for selectively driving a plurality of thin film transistors of the liquid crystal display; a plurality of source drivers for receiving an image signal, the plurality of source drivers cooperating with the plurality of gate drivers to display an image on the liquid crystal display, each of the plurality of source drivers further comprising an adjustable common voltage generating circuit, each the adjustable common voltage generating circuit compensating, a common voltage output from each the adjustable common voltage generating circuit to make each the common voltage output from each the adjustable common voltage generating circuit the same or to make each the common voltage output to an ITO layer of a panel of the liquid crystal display the same, based on a common voltage adjustable data and a clock signal; and a timing sequence controller for providing a control signal and a data flow to the plurality of gate drivers and the plurality of source drivers and providing the common voltage adjustable data to each the adjustable common voltage generating circuit.

14 Claims, 5 Drawing Sheets

DRIVING CIRCUIT OF LIQUID CRYSTAL DISPLAY

CROSS REFERENCE TO RELATED APPLICATIONS

This application claims the priority benefit of Taiwan application serial no. 93108464, filed on Mar. 29, 2004.

BACKGROUND OF INVENTION

1. Field of the Invention

This invention generally relates to a driving circuit of a liquid crystal display (LCD), and more particularly to a driving circuit capable of providing a uniform common voltage distribution.

2. Description of Related Art

Recently, as the image display technology advances, a significant number of the traditional CRT monitors has been replaced by the flat panel displays. Among the flat panel displays, the thin-film transistor liquid crystal display (TFT-LCD) is most popular. In addition, the flat panel display using the light-emitting diodes or plasma has also become more popular than ever.

The display part of the flat panel display comprises a pixel array. The pixel array generally is a row-column matrix. The pixels are controlled by the drivers. The drivers drive the corresponding pixels according to rasterized image data, and the pixels will display the designated colors at prescribed time.

The LCD panel comprises an ITO layer. The ITO layer is connected to the common voltage. As the size of the TFT-LCD panel increases, the length of the layout of the common voltage becomes longer. Hence, the uniformity of the common voltage distribution on the ITO layer becomes worse. This non-uniformity of the common voltage distribution can be solved by reducing the resistance of the ITO layer. Additionally, improvement of the common voltage supply and response can further improve the flicker, and improvement of the panel and driver layout can improve the uniformity of the common voltage distribution. However the common voltage drop cannot be compensated effectively due to its inherent structure.

FIG. 1 is a traditional common voltage wire layout and the voltage adjustment circuit. Referring to FIG. 1, the common voltage Vcom is obtained by dividing the power supply VDD by the adjustable resistor 18*a* and amplified by the OP buffer 18*b* to drive the load on the entire panel 12. The fine tuning of the above voltage divider can be implemented by the mechanical trimmer of the resistor. Because the best common voltage for each panel would be slightly different, before the panel is shipped out of factory, the common voltage adjustment is necessary. The trimmer 18*c* is generally disposed on one end of the driving circuit board 14 as shown in FIG. 1. The OP buffer 18*b* and the resistor trimmer 18*a*/18*c* are disposed on the other end of the driving circuit board 14 and the panel 12. The common voltage wire 16 on the glass substrate of the TFT-LCD is coupled to the buffer 18*b* via the driving circuit board 14 from the source driver side.

Under this structure, the output voltage of the buffer 18*b* will be sent to every points (e.g., points A, B, and C) on the panel 12 via the common voltage wire 16. The fixed common voltage Vcom will drop for example from point A to point C due to the common voltage wire 16 and the panel 12 so that the common voltage distribution on the panel 12 is non-uniform.

Therefore, how to enhance the display quality and improve the uniformity of the common voltage distribution is very important. Due to the traditional circuit characteristics, the voltage drop of the common voltage Vcom cannot be improved effectively. How to modify the common voltage wire and circuit becomes an important issue.

SUMMARY OF INVENTION

The present invention is directed to a driving circuit of a LCD so that the common voltage distribution on the ITO layer is more uniform to enhance the display quality.

The present invention is directed to a driving circuit of a LCD for automatically adjusting the common voltage so that common voltage distribution on the ITO layer is more uniform.

The present invention is directed to a driving circuit of a LCD so that the gate driver and the source driver can generate different compensating voltage for the common voltage in order to trim each common voltage in order to obtain a more uniform common voltage distribution.

According to an embodiment of the present invention, the driving circuit comprises a plurality of gate drivers, a plurality of source drivers and a timing sequence controller. The gate drivers are adapted for selectively driving a plurality of thin film transistors of the liquid crystal display. The source drivers are adapted for receiving an image signal, wherein the plurality of source drivers cooperate with the plurality of gate drivers to display an image on the liquid crystal display. Each of the plurality of source drivers comprises an adjustable common voltage generating circuit, wherein each adjustable common voltage generating circuit, based on a common voltage adjustable data and a clock signal, compensates a common voltage output from each the adjustable common voltage generating circuit to make each the common voltage output from each the adjustable common voltage generating circuit substantially same or to make each the common voltage output to an ITO layer of a panel of the liquid crystal display substantially same. The timing sequence controller is adapted for providing a control signal and a data flow to the plurality of gate drivers and the plurality of source drivers and for providing the common voltage adjustable data to each the adjustable common voltage generating circuit.

In an embodiment of the present invention, the adjustable common voltage generating circuit comprises a digital interface, a digital to analog converter and an output buffer. The digital interface is adapted for receiving the common voltage adjustable data and the clock signal. The digital to analog converter is coupled to the digital interface and is adapted for generating an analog signal based on the common voltage adjustable data. The output buffer is coupled to the digital to analog converter and is adapted for generating the common voltage based on the analog signal to drive a load of the common voltage.

By using the above structure, the common voltage generator in each source driver or/and each gate driver is capable of outputting the same common voltage in order to resolve the non-uniformity of the common voltage distribution In an embodiment of the present invention, the digital interface comprises at least one of a serial digital interface, a parallel digital interface, a single-ended digital interface and a differential digital interface. The digital interface comprises a shift register and/or a latch and the output buffer comprises an operational amplifier.

In an embodiment of the present invention, the timing sequence controller comprises a timing sequence control unit and a common voltage adjustable data generating unit. The timing sequence control unit is adapted for providing the control signal and the data flow, and the common voltage adjustable data generating unit is coupled to the timing sequence control unit and is adapted for generating the common voltage adjustable data. An operational timing sequence of the common voltage adjustable data generating unit is controlled by the timing sequence control unit.

In an embodiment of the present invention, the common voltage adjustable data generating unit comprises a processing unit, a storage unit and an interface unit. The processing unit is adapted for obtaining an optimum common voltage data based on an input data to generate the common voltage adjustable data. The storage unit is coupled to the processing unit and is adapted for storing the optimum common voltage data. The interface unit is coupled to the processing unit and is adapted for outputting the common voltage adjustable data to the adjustable common voltage generating circuit.

The above is a brief description of some deficiencies in the prior art and advantages of the present invention. Other features, advantages and embodiments of the invention will be apparent to those skilled in the art from the following description, accompanying drawings and appended claims.

DETAILED DESCRIPTION

Figure 1:
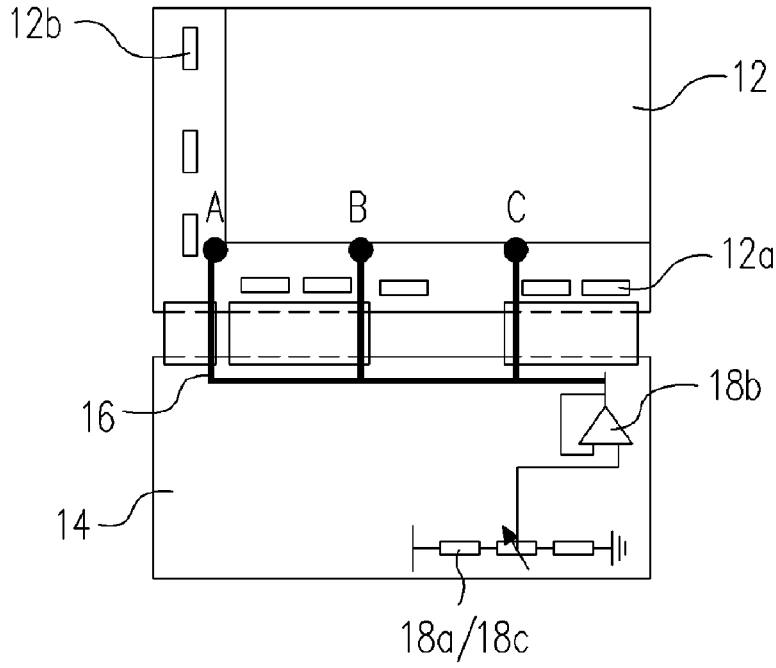
FIG. 1 (PRIOR ART)
FIG. 1 is a traditional common voltage circuit layout and the voltage adjustment circuit.
Figure 2:
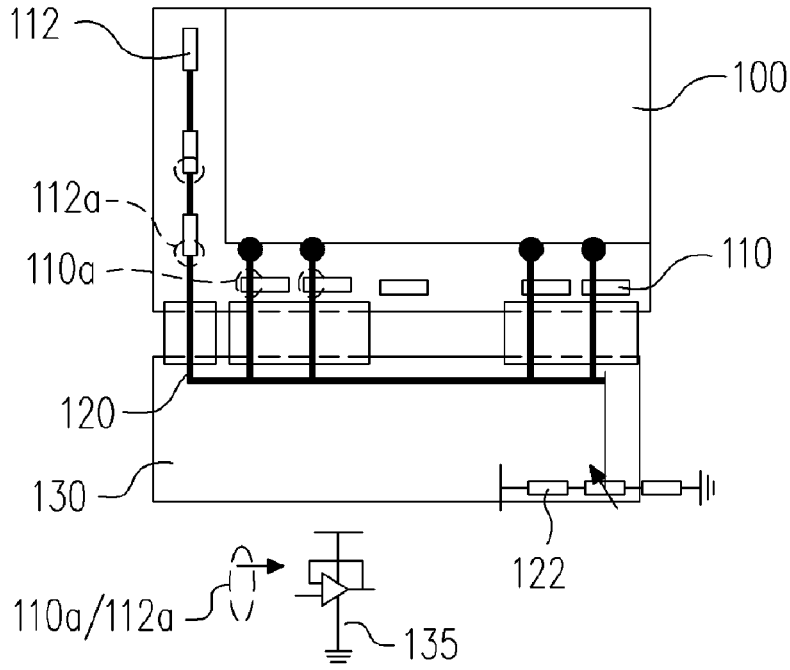
FIG. 2 is a driving circuit of a LCD and a common voltage circuit layout in accordance with a first embodiment of the present invention.

FIG. 2 is a driving circuit of a LCD and a common voltage wire layout in accordance with a first embodiment of the present invention. The structure in FIG. 2 is an improved structure of FIG. 1. As shown in FIG. 2, the buffer, which was originally disposed on the circuit board 130, is disposed inside each source driver 110 and each gate driver 112 (e.g., at the location 112*a* and 110*a* in FIG. 2). The layout of the common voltage wire 120 is extended from the circuit board 130 to each source driver 110 and the ITO layer (not shown) inside the panel 100. In addition, the common voltage wire 120 is also extended to each gate driver 112 so that each gate driver 112 can output the common voltage Vcom.

Under this structure, the common voltage Vcom is output from each source driver to the ITO layer inside the panel 100 and the adjustable resistor/trimmer 122 is still on the circuit board 130, i.e., the fine tune of the common voltage is performed manually. However, because the buffer 135 is integrated into the source driver 110 and the gate driver 112, and the input terminal of the buffer 135 is a high resistance node, there will be no current flowing between the adjustable resistor/trimmer 122 and the buffer 135. Hence, the common voltage Vcom output by each source driver 110 will be more uniform and thus overcomes the drawback of the common voltage drop in the prior art and resolve the flicker issue.

Although the above structure can partially resolve the common voltage drop issue, the fine tune of the common voltage is performed manually. To further effectively prevent the common voltage drop and to automatically or dynamically adjust the common voltage, the following embodiment is proposed.

Figure 3:
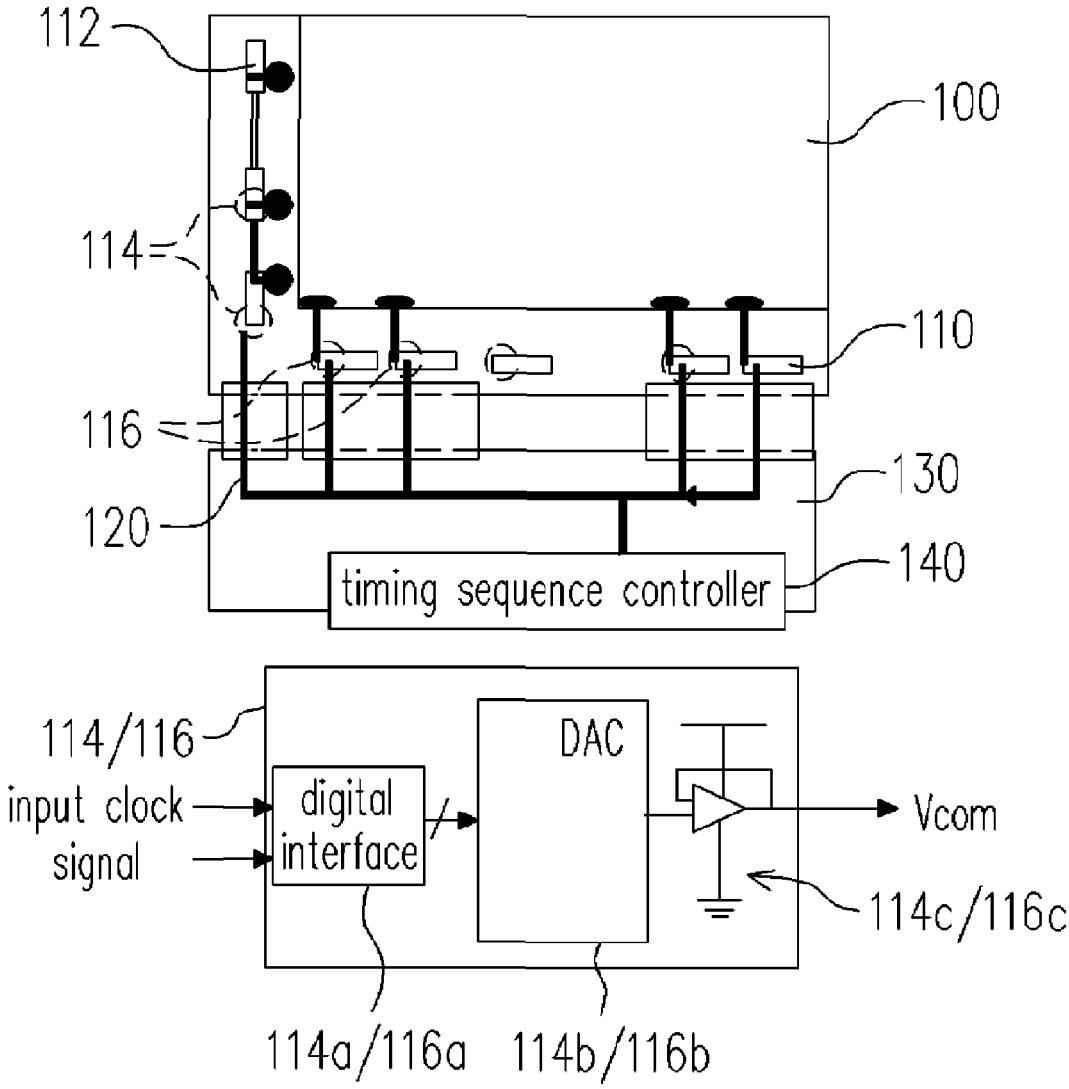
FIG. 3 is a driving circuit of a LCD and a common voltage circuit layout in accordance with a second embodiment of the present invention.
Figure 4:
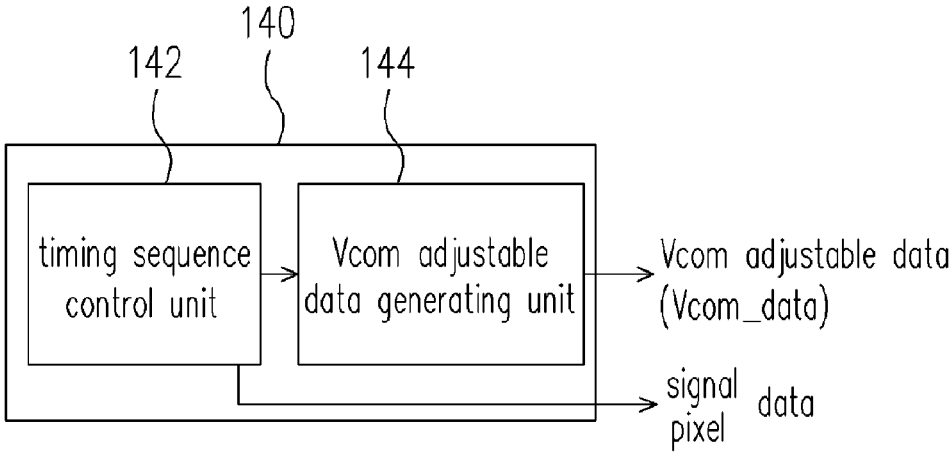
FIG. 4 is a block diagram of the timing controller of FIG. 3.
Figure 5:
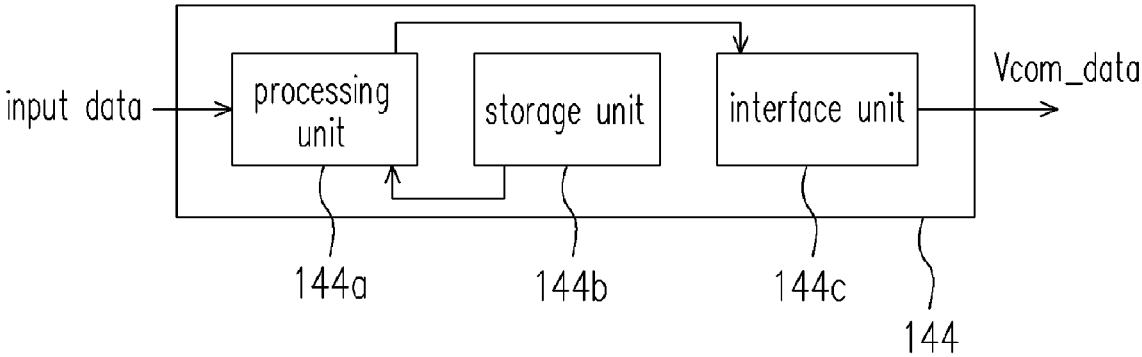
FIG. 5 is a block diagram of the adjustable common voltage data generating unit of FIG. 4.

FIG. 3 is a driving circuit of a LCD and a common voltage wire layout in accordance with a second embodiment of the present invention. The LCD driving circuit comprises at least a plurality of gate drivers 112 for selectively driving a plurality of thin film transistors of the liquid crystal display and a plurality of source drivers 110 for receiving an image signal, the plurality of source drivers cooperating with the plurality of gate drivers to display an image on the liquid crystal display. Each source driver 110 further comprises an adjustable common voltage generating circuit 116 and each adjustable common voltage generating circuit 116 compensates the common voltage Vcom output from each adjustable common voltage generating circuit 116 based on a common voltage adjustable data (Vcom_data as shown in FIGS. 4 and 5) and a clock signal so as to make each the common voltage output from each the adjustable common voltage generating circuit substantially same. Further, the adjustable common voltage generating circuit 114 can also be integrated into each gate driver 112 so that the common voltage distribution can be more uniform. The driving circuit further comprises the timing sequence controller 140 for providing a control signal and a data flow to the plurality of gate drivers 112 and the plurality of source drivers 110 and for providing the common voltage adjustable data to the adjustable common voltage generating circuits 114 and 116.

As shown in FIG. 3, the above adjustable common voltage generating circuits 114 and 116 further comprises the digital interface 114*a*/116*a*, a digital to analog converter (DAC) 114*b*/116*b*. The digital interface 114*a*/116*a* is adapted for receiving the common voltage adjustable data Vcom_data and the clock signal. The digital to analog converter (DAC) 114*b*/116*b* is coupled to the digital interface 114*a*/116*a* and is adapted for generating an analog signal based on the common voltage adjustable data Vcom_data. The output buffer 114*c*/116*c* is coupled to the digital to analog converter and is adapted for generating the common voltage Vcom based on the analog signal to drive a load of the common voltage. The digital interface 114*a*/116*a* can be at least one of a serial digital interface, a parallel digital interface, a single-ended digital interface and a differential digital interface. The digital interface 114*a*/116*a* comprises, for example, a shift register and/or a latch. The output buffer 114*c*/116*c* can be constructed by, for example, an operational amplifier.

FIG. 4 is a block diagram of the timing controller of FIG. 3. As shown in FIG. 4, the timing sequence controller 140 comprises a timing sequence control unit 142; and a common voltage adjustable data generating unit 144 is coupled to the timing sequence control unit 142 and is adapted for generating the common voltage adjustable data Vocm_data and for outputting the common voltage adjustable data Vocm_data to the common voltage generator 114 of each gate driver 112 and to the common voltage generator 116 of each source driver 110. The timing sequence control unit 142 can be, for example, a traditional timing sequence controller and can be adapted for providing the control signal and the data flow to each source driver 110 and gate driver 112. The common voltage adjustable data generating unit 144 can generate the data to adjust the common voltage Vcom to dynamically adjust the common voltage Vcom on the ITO layer of the panel 100 so that each common voltage can be the same or substantially the same or each common voltage on the ITO layer can be the same or substantially the same in order to achieve the object of the uniform common voltage distribution. The operational timing sequence for the common voltage adjustable data generating unit 144 is controlled by the timing sequence control unit 142.

FIG. 5 is a block diagram of the adjustable common voltage data generating unit of FIG. 4. The common voltage adjustable data generating unit 144 comprises a processing unit 144*a*, a storage unit 144*b* and an interface unit 144*c*. The processing unit 144*a* receives input data from the timing sequence control unit 142. The processing unit 144*a* can be a micro processing unit. The storage unit 144*b* is coupled to the processing unit for storing data related to the adjustment or fine adjustment of the common voltage. The processing unit 144*a* obtains the data related to the adjustment or fine adjustment amount of the common voltage from the storage unit 144*b* based on the received input data. Then the processing unit 144*a* outputs data related to the adjustment or fine adjustment amount of the common voltage from the timing sequence controller 140 via the interface 144*c*.

Referring to FIG. 3, after the common voltage adjustable data Vocm_data is output from the timing sequence controller 140 via the interface 144*c*, the common voltage adjustable data Vocm_data is transmitted to the common voltage generator 116 of each source driver 110 and the common voltage generator 114 of each gate driver 112. Then the common voltage generators 114 and 116 output the common voltage Vcom to the ITO layer of the panel 100. Under this structure, because the common voltage generators 114 and 116 of each source driver 110 and gate driver 112 will generate different common voltage compensation amounts, the final common voltages output from the common voltage generators 114 and 116 are the same or substantially the same, or the common voltages on the ITO layer are the same or substantially the same. Hence, the common voltages Vcom on the ITO layer are more uniform in order to eliminate the flicker.

Figure 6:
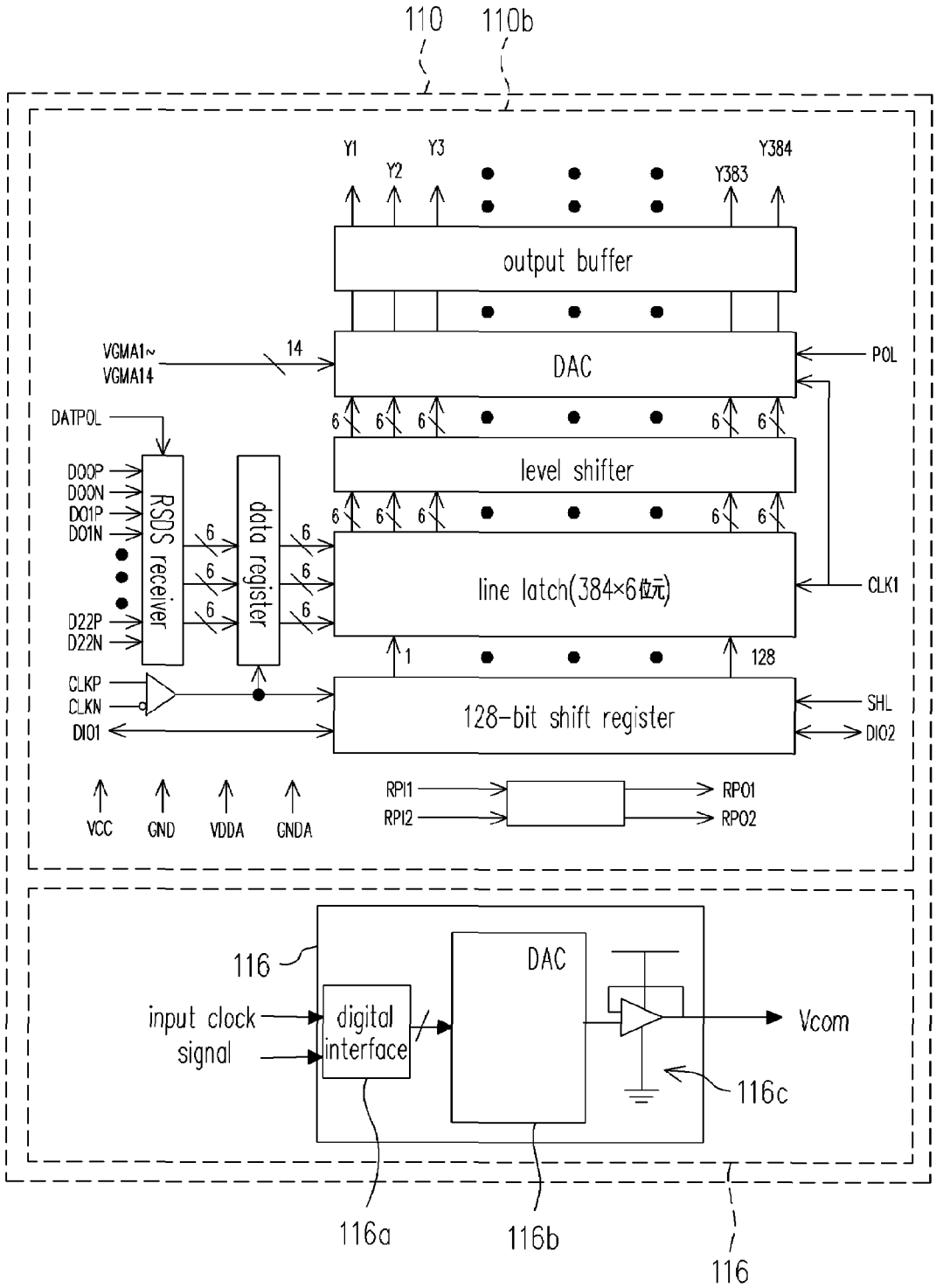
FIG. 6 is a diagram of the source driver with the common voltage data generator according to an embodiment of the present invention.

FIG. 6 is the diagram of the source driver with the common voltage data generator of the present invention. As shown in FIG. 6, the source driver 110, in addition to the ordinary source driver 110*b* (i.e., the RSDS receiver, the data register, the shift register, the line latch, the level shifter, the DAC and the output buffer in FIG. 6) further comprises the common voltage generator 116. The function and the structure of the source driver 110*b* are similar to the prior art and thus there is no need to describe it. The common voltage generator 116 comprises the digital interface 116*a*, the DAC 116*b* and the output buffer 116*c*.

The digital interface 116*a* receives the common voltage adjustable data Vcom_data from the common voltage adjustable data generating unit 144. The DAC 116*b* then generates an analog signal based on the common voltage adjustable data Vcom_data from the digital interface 116*a*. The output buffer 116*c* then amplifies the analog signal to generate the common voltage Vcom. The DAC 116*b* can be any kind of DAC and can be fine-tuned.

Hence, by using the above structure, the present invention combines the ordinary source driver and the common voltage generator into a single module. Via the source driver of the present invention, all source drivers will output the common voltage Vcom to the ITO layer of the panel. In addition, because the common voltage generators in all source drivers will generate different common voltage compensation amounts based on specific conditions, the common voltages on the ITO layer are the same or substantially the same. Hence, the common voltages on the ITO layer are more uniform in order to eliminate the flicker.

Figure 7:
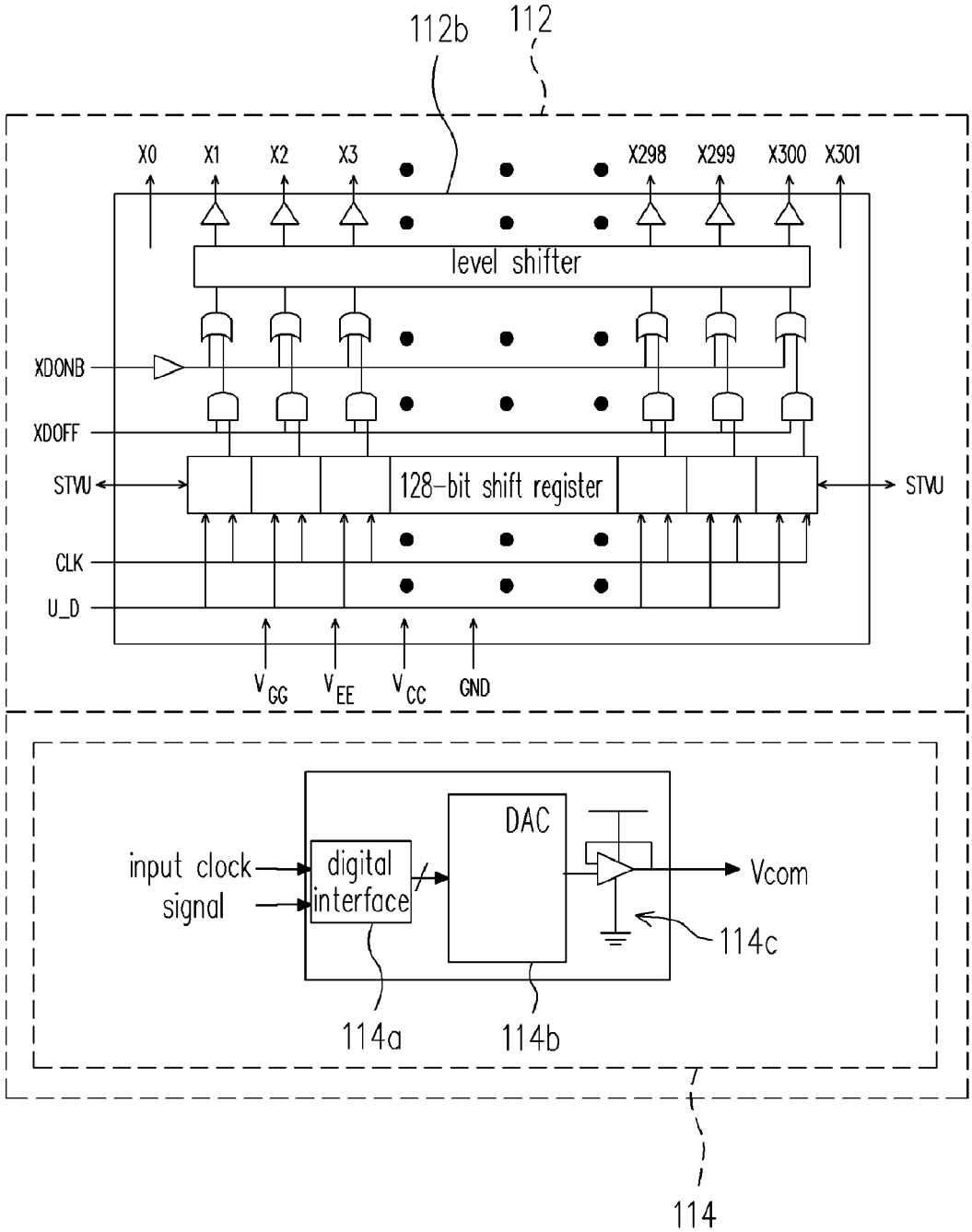
FIG. 7 is a diagram of the gate driver with the common voltage data generator according to an embodiment of the present invention.

FIG. 7 is the diagram of the gate driver with the common voltage data generator of the present invention. As shown in FIG. 7, the gate driver 112, in addition to the ordinary gate driver 112*b* (i.e., the RSDS receiver, the data register, the shift register, the line latch, the level shifter, the DAC and the output buffer in FIG. 7) further comprises the common voltage generator 114. The function and the structure of the gate driver 112*b* are similar to the prior art and therefore detail description thereof is omitted herein. The common voltage generator 114 comprises the digital interface 114*a*, the DAC 114*b* and the output buffer 114*c*.

The digital interface 114*a* receives the common voltage adjustable data Vcom_data from the common voltage adjustable data generating unit 144. The DAC 114*b* then generates an analog signal based on the common voltage adjustable data Vcom_data from the digital interface 114*a*. The output buffer 116*c* then amplifies the analog signal to generate the common voltage Vcom. The DAC 114*b* can be any kind of DAC and can be fine-tuned.

Hence, by using the above structure, the present invention combines the ordinary gate driver and the common voltage generator into a single module. Via the gate driver of the present invention, all gate drivers will output the common voltage Vcom to the ITO layer of the panel. In addition, because the common voltage generators in all source drivers will generate different common voltage compensation amounts based on specific conditions, the common voltages on the ITO layer are the same or substantially the same. Hence, the common voltages on the ITO layer are more uniform in order to eliminate the flicker.

In an embodiment of the present invention, the above common voltage generator can be disposed into the source driver and the gate driver. Hence, the common voltage generator in each source driver or/and each gate driver will output the same common voltage in order to resolve the non-uniformity of the common voltage distribution.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

The invention claimed is:

1. A driving circuit of a liquid crystal display, comprising:

a plurality of gate drivers, for selectively driving a plurality of thin film transistors of the liquid crystal display;

a plurality of source drivers, for receiving an image signal, the plurality of source drivers cooperating with the plurality of gate drivers to display an image on the liquid crystal display, each of the source drivers further comprising an adjustable common voltage generating circuit, each adjustable common voltage generating circuit compensating a common voltage output from each adjustable common voltage generating circuit to make each common voltage output from each adjustable common voltage generating circuit the same or to make each common voltage output to an ITO layer of a panel of the liquid crystal display the same based on a common voltage adjustable data and a clock signal; and a timing sequence controller comprising a timing sequence control unit and a common voltage adjustable data generating unit coupled to the timing sequence control unit, for providing a control signal and a data flow provided by the timing sequence control unit to the gate drivers and the source drivers, and providing the common voltage adjustable data generated by the common voltage adjustable data generating unit to each adjustable common voltage generating circuit;

wherein the common voltage adjustable data generating unit comprises:

a processing unit, for obtaining an optimum common voltage data based on an input data to generate the common voltage adjustable data;

a storage unit, coupled to the processing unit, for storing the optimum common voltage data; and an interface unit, coupled to the processing unit, for outputting the common voltage adjustable data to each adjustable common voltage generating circuit.

2. The driving circuit of claim 1, wherein the adjustable common voltage generating circuit comprises:

a digital interface, for receiving the common voltage adjustable data and the clock signal;

a digital to analog converter, coupled to the digital interface, for generating an analog signal based on the common voltage adjustable data; and an output buffer, coupled to the digital to analog converter, for generating the common voltage based on the analog signal to drive a load of the common voltage.

3. The driving circuit of claim 2, wherein the digital interface comprises at least one of a serial digital interface, a parallel digital interface, a single-ended digital interface and a differential digital interface.

4. The driving circuit of claim 2, wherein the digital interface comprises a shift register.

5. The driving circuit of claim 2, wherein the digital interface comprises a latch.

6. The driving circuit of claim 2, wherein the output buffer comprises an operational amplifier.

7. The driving circuit of claim 1, wherein an operational timing sequence for the common voltage adjustable data generating unit is controlled by the timing sequence control unit.

8. A driving circuit of a liquid crystal display, comprising:

a plurality of gate drivers, for selectively driving a plurality of thin film transistors of the liquid crystal display, each of the gate drivers comprising a first adjustable common voltage generating circuit, each first adjustable common voltage generating circuit compensating a common voltage output from each first adjustable common voltage generating circuit to make each common voltage output from each first adjustable common voltage generating circuit the same or to make each common voltage output to an ITO layer of a panel of the liquid crystal display the same based on a common voltage adjustable data and a clock signal;

a plurality of source drivers for receiving an image signal, the source drivers cooperating with the gate drivers to display an image on the liquid crystal display, each of the source drivers further comprising a second adjustable common voltage generating circuit, each second adjustable common voltage generating circuit compensating a common voltage output from each second adjustable common voltage generating circuit to make each common voltage output from each second adjustable common voltage generating circuit the same or to make each common voltage output to an ITO layer of a panel of the liquid crystal display the same based on the common voltage adjustable data and the clock signal; and a timing sequence controller comprising a timing sequence control unit and a common voltage adjustable data generating unit coupled to the timing sequence control unit, for providing a control signal and a data flow provided by the timing sequence control unit to the gate drivers and the source drivers and providing the common voltage adjustable data generated by the common voltage adjustable data generating unit to each first and second adjustable common voltage generating circuits;

wherein the common voltage adjustable data generating unit comprises:

a processing unit, for obtaining an optimum common voltage data based on an input data to generate the common voltage adjustable data;

a storage unit, coupled to the processing unit, for storing the optimum common voltage data; and an interface unit, coupled to the processing unit, for outputting the common voltage adjustable data to each first and second adjustable common voltage generating circuits.

9. The driving circuit of claim 8, wherein each of the first and second adjustable common voltage generating circuits comprises:

a digital interface, for receiving the common voltage adjustable data and the clock signal;

a digital to analog converter, coupled to the digital interface, for generating an analog signal based on the common voltage adjustable data; and an output buffer, coupled to the digital to analog converter, for generating the common voltage based on the analog signal to drive a load of the common voltage.

10. The driving circuit of claim 9, wherein the digital interface comprises at least one of a serial digital interface, a parallel digital interface, a single-ended digital interface and a differential digital interface.

11. The driving circuit of claim 9, wherein the digital interface comprises a shift register.

12. The driving circuit of claim 9, wherein the digital interface comprises a latch.

13. The driving circuit of claim 9, wherein the output buffer comprises an operational amplifier.

14. The driving circuit of claim 8, wherein an operational timing sequence for the common voltage adjustable data generating unit is controlled by the timing sequence control unit.

* * * * *